US009466906B2

(12) United States Patent
Koyama et al.

(10) Patent No.: US 9,466,906 B2
(45) Date of Patent: Oct. 11, 2016

(54) RESILIENT CONTACT TERMINAL AND CONNECTOR USING SAME

(71) Applicant: OMRON Corporation, Kyoto-shi, Kyoto (JP)

(72) Inventors: Jiro Koyama, Shanghai (CN); Hirotada Teranishi, Osaka (JP); Takahiro Sakai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/384,325

(22) PCT Filed: Mar. 14, 2013

(86) PCT No.: PCT/JP2013/057253

§ 371 (c)(1),
(2) Date: Sep. 10, 2014

(87) PCT Pub. No.: WO2013/137405

PCT Pub. Date: Sep. 19, 2013

(65) Prior Publication Data

US 2015/0064981 A1 Mar. 5, 2015

(30) Foreign Application Priority Data

Mar. 15, 2012 (JP) ..... 2012-059298

(51) Int. Cl.
*H01R 4/48* (2006.01)
*H01R 13/11* (2006.01)
*H01R 13/24* (2006.01)

(52) U.S. Cl.
CPC ..... *H01R 13/11* (2013.01); *H01R 13/2428* (2013.01)

(58) Field of Classification Search
CPC ..... H01R 13/2442
USPC ..... 439/862
See application file for complete search history.

(56) References Cited

U.S. PATENT DOCUMENTS 4,995,816 A * 2/1991 Grabbe ..... H01R 12/714 439/68
5,772,449 A * 6/1998 Feldmeier ..... H01R 25/142 439/289

(Continued)

FOREIGN PATENT DOCUMENTS

JP 2001-237015 A 8/2001
JP 2008-276987 A 11/2008

(Continued)

OTHER PUBLICATIONS

International Search Report for corresponding International Application No. PCT/JP2013/057253, mailed May 14, 2013 (4 pages).

(Continued)

*Primary Examiner* — Neil Abrams
(74) *Attorney, Agent, or Firm* — Osha Liang LLP

(57) ABSTRACT

A connection terminal has a movable contact portion that protrudes so as to be able to be pressed from an outside of a contact hole of a housing, and a first curved portion and a second curved portion that are continuously disposed and form a substantial S-shape. The movable contact portion is provided in a free end portion of the first curved portion. A position controlling projection extends from the movable contact portion. The position controlling projection abuts on an inner circumferential surface of the first curved portion or a region where the first curved portion and the second curved portion are continuously coupled to each other when the movable contact portion is pressed.

7 Claims, 12 Drawing Sheets

(56) References Cited

U.S. PATENT DOCUMENTS

| | | | | |
|---|---|---|---|---|
| 7,040,935 | B2 * | 5/2006 | Wei | H01R 43/16 439/700 |
| 7,150,658 | B1 * | 12/2006 | Chien | H01R 13/2428 439/700 |
| 8,100,731 | B2 * | 1/2012 | Koyama | H01R 13/2428 439/504 |
| 8,197,290 | B2 * | 6/2012 | Koyama | H01R 13/2428 439/474 |
| 8,556,667 | B2 * | 10/2013 | Koyama | H01R 13/41 439/474 |
| 8,657,635 | B2 * | 2/2014 | Koyama | H01R 13/2464 439/500 |
| 8,784,145 | B2 * | 7/2014 | Koyama | H01R 13/2464 439/500 |
| 2008/0268675 | A1 * | 10/2008 | Suzuki | H01R 13/2442 439/82 |
| 2012/0108111 | A1 | 5/2012 | Koyama et al. | |
| 2012/0171905 | A1 | 7/2012 | Koyama et al. | |
| 2015/0064981 | A1 * | 3/2015 | Koyama | H01R 13/2428 439/682 |

FOREIGN PATENT DOCUMENTS

| | | | |
|---|---|---|---|
| JP | 4811530 | B1 | 11/2011 |
| JP | 4883215 | B1 | 2/2012 |
| KR | 2008-0110513 | A | 12/2008 |

OTHER PUBLICATIONS

Notification of Reasons for Refusal issued in corresponding Korean Application No. 10-2014-7023831, mailed on Sep. 10, 2015 (7 pages).

* cited by examiner

RESILIENT CONTACT TERMINAL AND CONNECTOR USING SAME

BACKGROUND

1. Technical Field

The present invention relates to a connection terminal, for example to a connection terminal that not only is incorporated in a housing to constitute a connector but also can be used while directly mounted on a laterally end surface of a board.

2. Related Art

As to the conventional connection terminal, for example, there is an IC socket contact in which a core portion and a terminal contact portion are integrally formed while a spring side portion coupled to a support side portion is interposed therebetween. In the IC socket contact, the spring side portion has a horizontally substantial U-shape including an upper piece arm extending from the coupling portion to the terminal contact portion and a lower piece arm extending to the core portion, the upper piece arm includes first and second spring portions that extend in parallel while separating from each other, the lower piece arm includes third and fourth spring portions that extend in parallel while separating from each other, and the spring side portion has an inclined shape that comes down from the coupling side toward the core portion side (see Patent Document 1).

PATENT DOCUMENT

Patent Document 1: Japanese Unexamined Patent Publication No. 2001-237015

SUMMARY

However, in the IC socket contact, as illustrated in 2 of Patent Document 1, a tress is easily concentrated on core portion 5 when an external force is applied, which results in a plastic deformation being easily generated.

One or more embodiments of the present invention provides an excellent-durability connection terminal that relaxes the stress concentration to hardly generate the plastic deformation and a connector provided with the connection terminal.

In accordance with one or more embodiments of the present invention, a connection terminal includes a movable contact portion that protrudes so as to be able to be pressed from an outside of a contact hole of a housing, in the connection terminal, a substantial S-shape is formed by a first curved portion and a second curved portion, the first curved portion and the second curved portion being continuously provided, the movable contact portion is provided in a free end portion of the first curved portion, and a position controlling projection extends from the movable contact portion, the position controlling projection being configured to abut on an inner circumferential surface of the first curved portion or a region where the first curved portion and the second curved portion are continuously coupled to each other when the movable contact portion is pressed.

The substantial S-shape means a shape in which the first curved portion and the second curved portion are continuously coupled to each other such that opening directions of the first and second curved portions are oriented toward directions opposite to each other. More specifically, the opening directions of each of the first and second curved portions are oriented toward the directions opposite to a line segment connecting both ends of the continuous first and second curved portions.

According to one or more embodiments of the present invention, even if the external force is applied to the movable contact portion to elastically deform the connection terminal, the position controlling projection abuts on the inner circumferential surface of the first curved portion, so that a deformation amount of the first curved portion can be controlled to block the plastic deformation caused by the excessive load. Therefore, the connection terminal having the excellent durability can be provided.

In one or more embodiments of the present invention, the position controlling projection may extend from the movable contact portion, a leading end portion of the position controlling projection abutting on the inner circumferential surface of the first curved portion or the region where the first curved portion and the second curved portion are continuously coupled to each other so as to push out the inner circumferential surface or the region in an opening direction of the second curved portion.

According to one or more embodiments, linearly-applied external force is absorbed by converting the external force into a torsional force, so that the connection terminal standing up to the larger load can be obtained.

In one or more embodiments of the present invention, the position controlling projection may extend from the movable contact portion, a base of the position controlling projection abutting on the inner circumferential surface of the first curved portion after the leading end portion of the position controlling projection abuts on the inner circumferential surface of the first curved portion or the region where the first curved portion and the second curved portion are continuously coupled to each other so as to push out the inner circumferential surface or the region in the opening direction of the second curved portion.

According to one or more embodiments, the position controlling projection abuts on the inner circumferential surface of the first curved portion at two stages to disperse the external force, so that the plastic deformation of the first curved portion can more securely be prevented to obtain the connection terminal standing up to the large load.

In accordance with one or more embodiments of the invention, the connection terminal may further include a slit comprising a curved portion between a plurality of extending portions. In the connection terminal, the first curved portion and the second curved portion are formed by the plurality of extending portions.

According to one or more embodiments, the connection terminal having the larger elastic deformation amount can be obtained.

In one or more embodiments of the present invention, at least one abutment receiving portion configured to couple the plurality of extending portions may be provided at the abutment position of the position controlling projection.

According to one or more embodiments, by providing the abutment receiving portion, the impact force can be relaxed during the abutment of the position controlling projection while rigidity of the whole connection terminal is enhanced. Therefore, a fatigue failure is hardly generated and the durability is improved.

The abutment between the position controlling projection and the extending portion in which the abutment receiving portion is provided can decrease an electric resistance from the position controlling projection to the extending portion, and increase a current value passed through the connection terminal.

A connector according to one or more embodiments of the present invention may have a configuration in which the movable contact portion of the connection terminal protrudes so as to be able to be inserted in and taken out from an outside of a contact hole made in a housing.

According to one or more embodiments of the present invention, even if the external force is applied to the movable contact portion to elastically deform the connection terminal, the position controlling projection abuts on the inner circumferential surface of the first curved portion, so that the deformation amount of the first curved portion can be controlled to block the plastic deformation caused by the excessive load. Therefore, the connection terminal having the excellent durability is advantageously obtained.

DETAILED DESCRIPTION

Embodiments of the present invention will be described below with reference to FIGS. 1(A) to 10(B). In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As illustrated in FIGS. 1(A) to 6(B), in a connector according to a first embodiment, fixing metal fittings 20 are press-fitted in both ends of resin-molded housing 10, and connection terminals 30 are press-fitted in at predetermined intervals between fixing metal fittings 20 and 20.

The housing 10 of the connector has outside dimensions of a height of 3.5 mm and a maximum depth of 2.8 mm, and housing 10 is assembled in a printed board (not illustrated) by fitting housing 10 in a substantial U-shape notch provided in an upper-surface edge portion of the printed board.

Figure 5A:
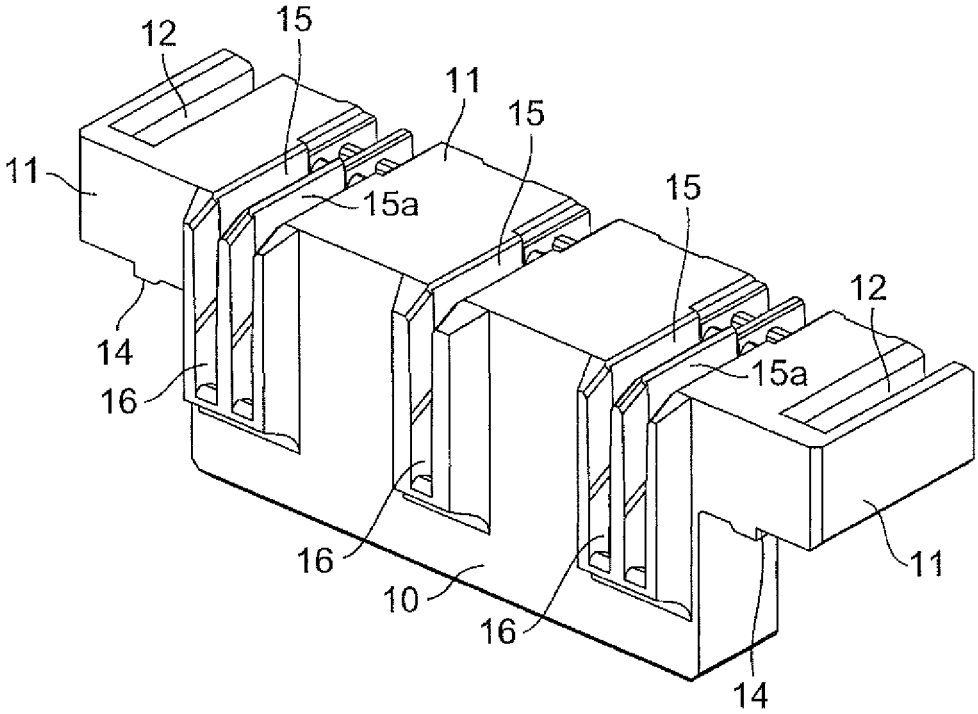
FIGS. 5(A), 5(B), and 5(C) are a perspective view, a partial sectional view, and a central sectional view illustrating a housing alone in FIGS. 1(A) to 1(C).
Figure 5B:
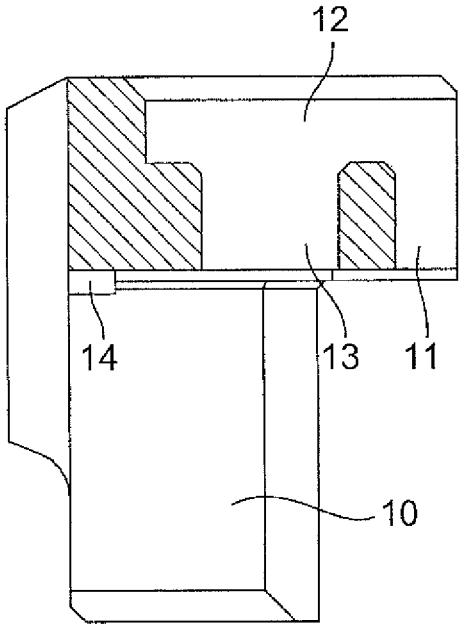
Figure 5C:
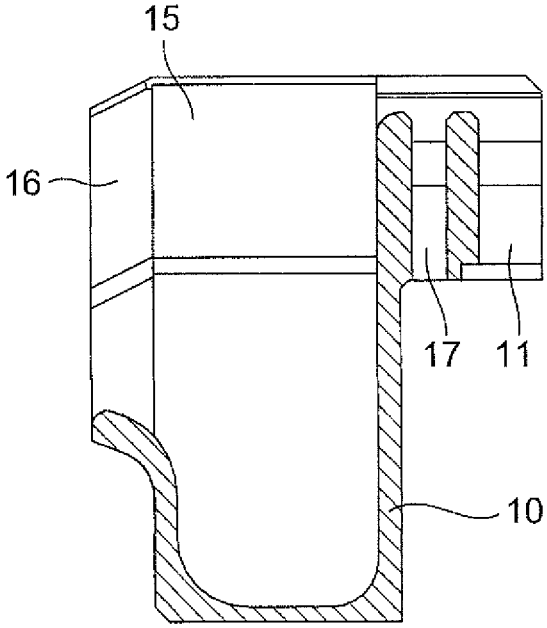

As illustrated in FIGS. 5(A) to 5(C), bulging-out portions 11 protrude laterally in housing 10, and bulging-out portions 11 are continuously provided along side surfaces and a rear surface of housing 10. First storage space 12 in which fixing metal fitting 20 can be press-fitted from above is provided at each end of bulging-out portion 11. Press-fitting latching hole 13 is made along inside surfaces opposed to each other in first storage space 12. Positioning protrusion 14 protrudes from a bottom base in bulging-out portion 11.

In housing 10, three of second storage spaces 15, in each of which connection terminal 30 can be press-fitted from above, are provided in parallel between first storage spaces 12 and 12. Particularly, second storage space 15 provided in a position adjacent to first storage space 12 is partitioned by partition wall 15*a*. Contact hole 16 is made on a front surface side of housing 10. Contact hole 16 is communicated with second storage space 15, and movable contact portion 40 of connection terminal 30 (to be described) can be inserted in and taken out from contact hole 16. Press-fitting latching hole 17 communicated with second storage space 15 is also made in housing 10.

Figure 1A:
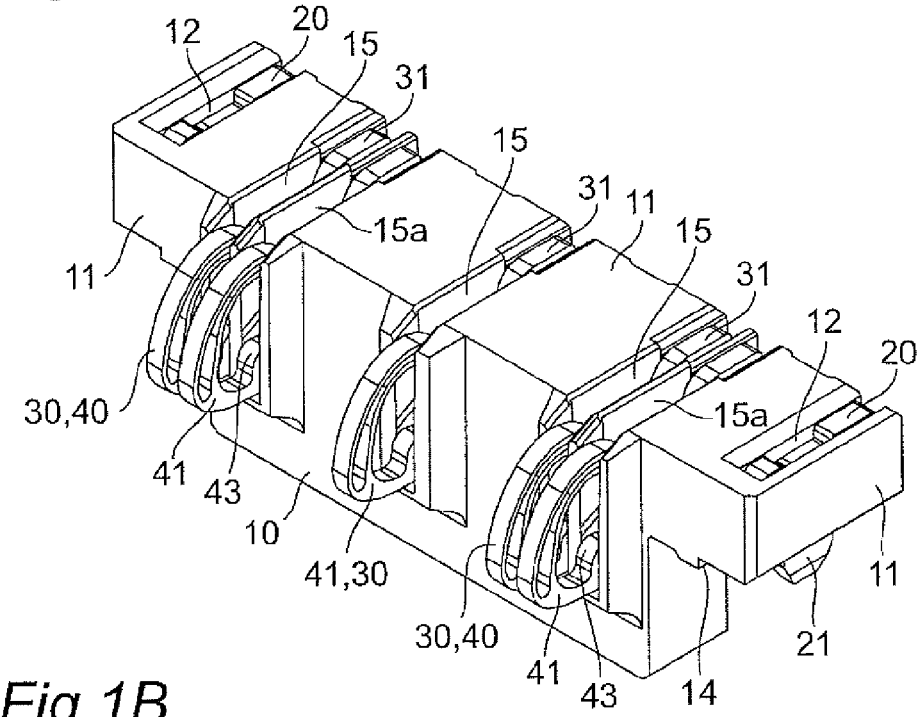
FIGS. 1(A), 1(B), and 1(C) are a perspective view, a right side view, and a partial sectional view illustrating a connector in which a connection terminal according to a first embodiment of the present invention is incorporated.
Figure 1B:
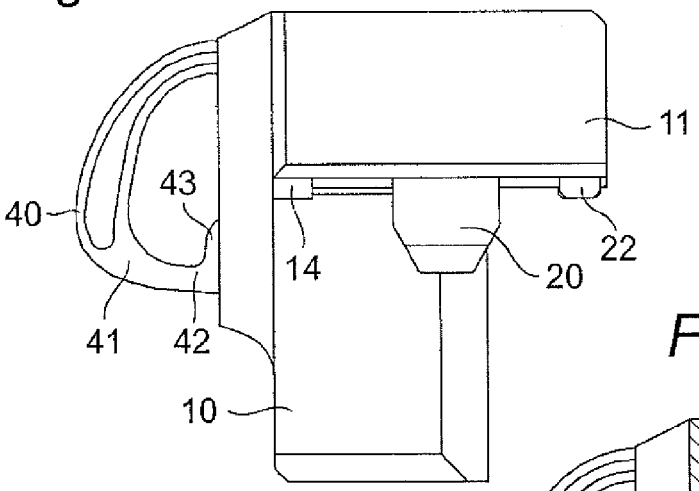
Figure 1C:
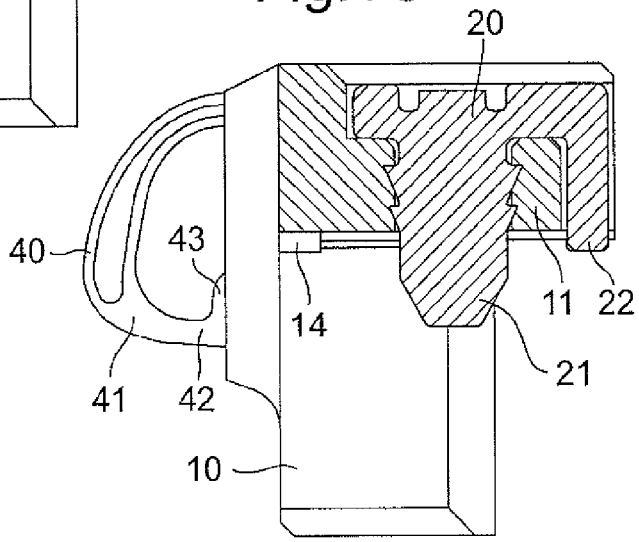
Figure 2A:
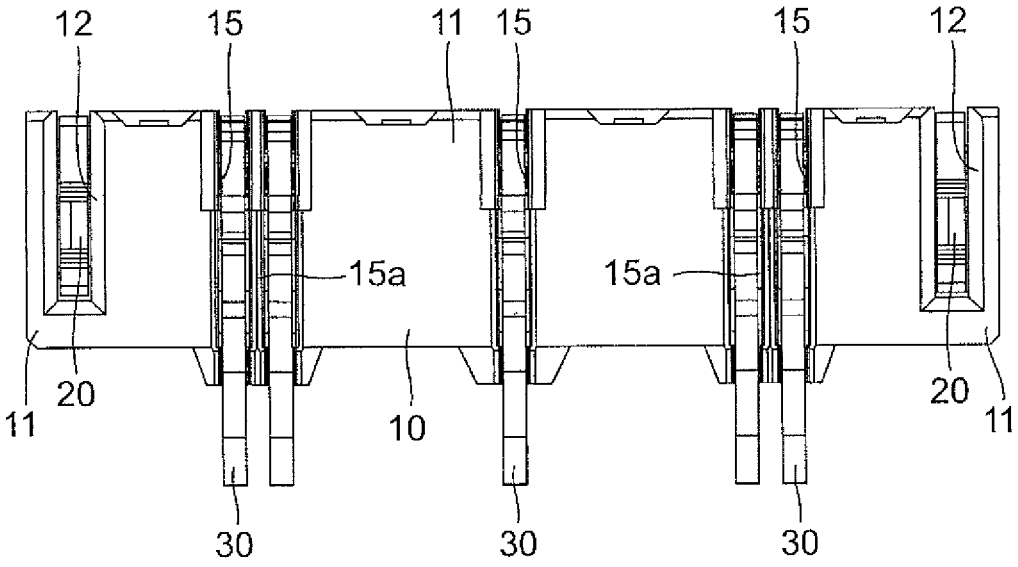
FIGS. 2(A) and 2(B) are a plan view and a front view illustrating the connector in which the connection terminal of the first embodiment in FIGS. 1(A) to 1(C) is incorporated.
Figure 2B:
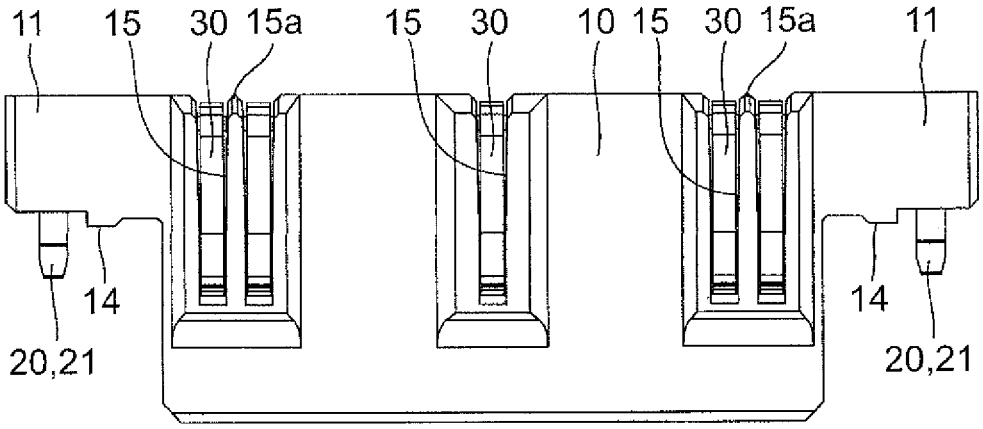
Figure 3A:
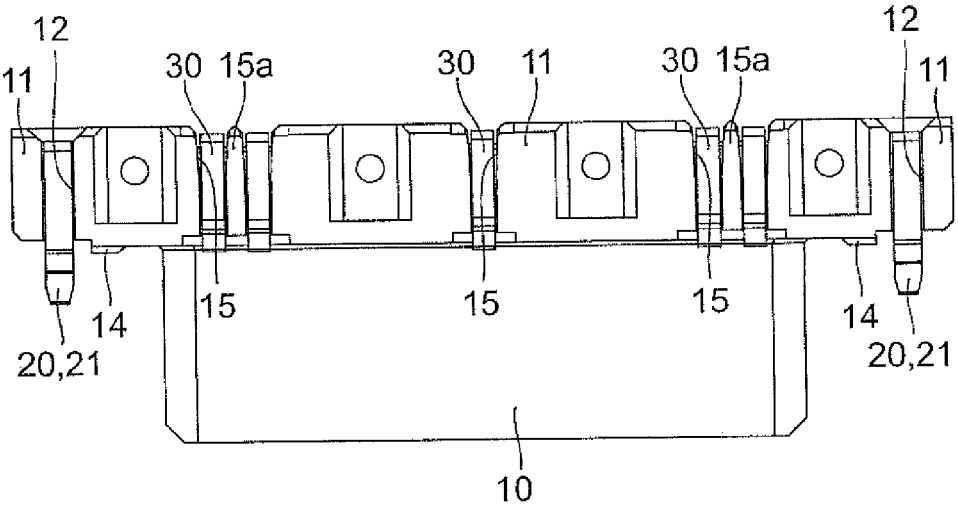
FIGS. 3(A) and 3(B) are a rear view and a bottom view illustrating the connector in which the connection terminal of the first embodiment in FIGS. 1(A) to 1(C) is incorporated.
Figure 3B:
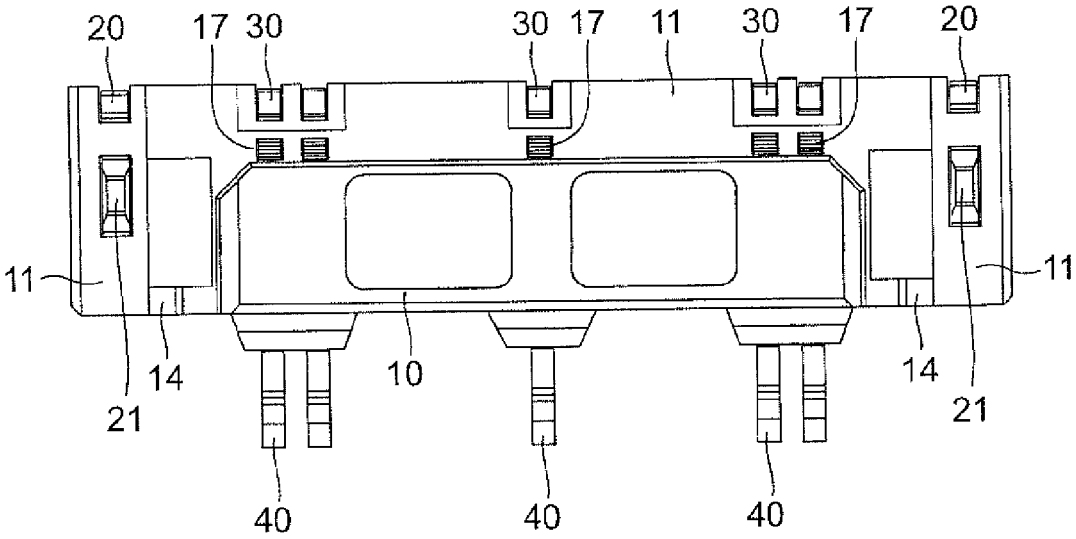

As illustrated in FIG. 1(C), fixing metal fitting 20 is a press-formed product that is formed by punching a metallic thin plate, and latching pawl 21 and positioning support 22 are provided in parallel in fixing metal fitting 20. Therefore, latching pawl 21 of fixing metal fitting 20 is press-fitted from above in press-fitting latching hole 13 of first storage space 12 provided in housing 10, whereby fixing metal fitting 20 is retained and positioning support 22 of fixing metal fitting 20 is flush with a lower end face of positioning protrusion 14 of housing 10.

Figure 6A:
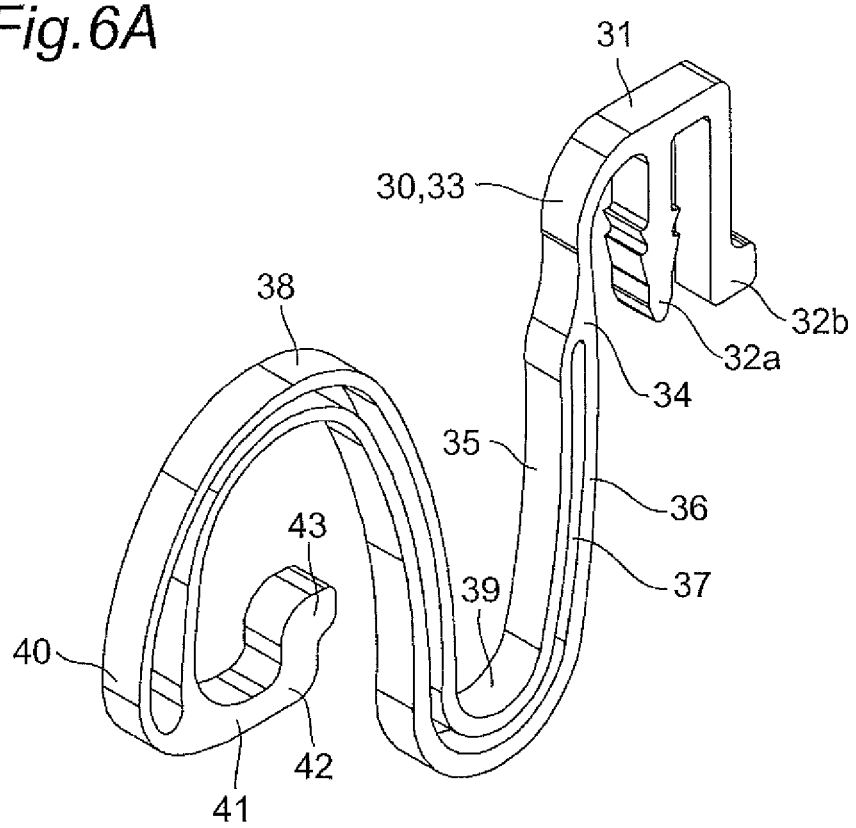
FIGS. 6(A) and 6(B) are a perspective view and a front view illustrating the connection terminal of the first embodiment.
Figure 6B:
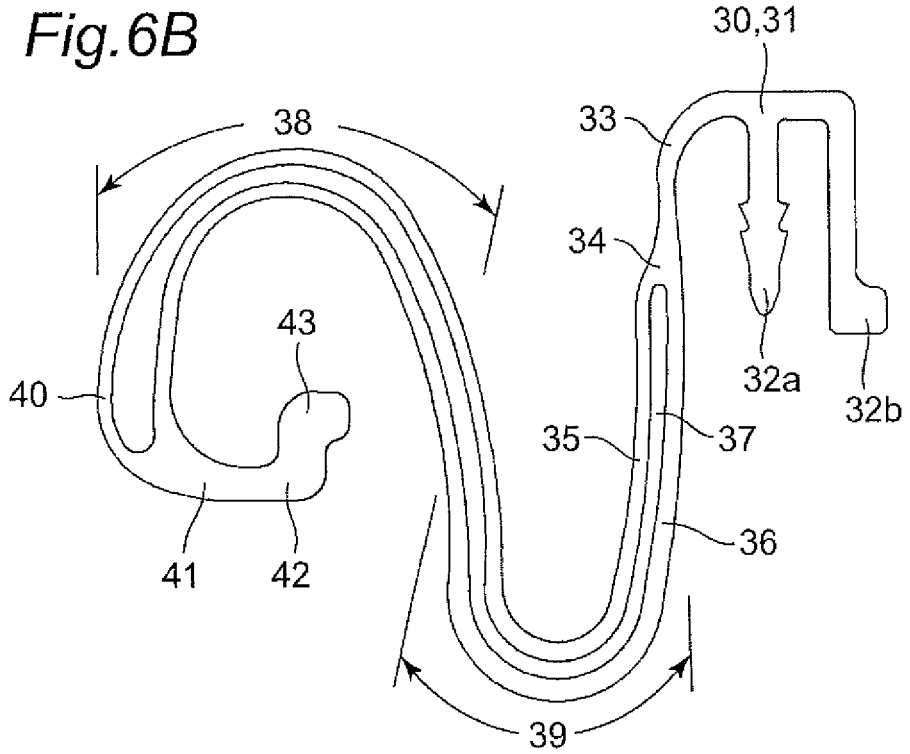
Figure 7A:
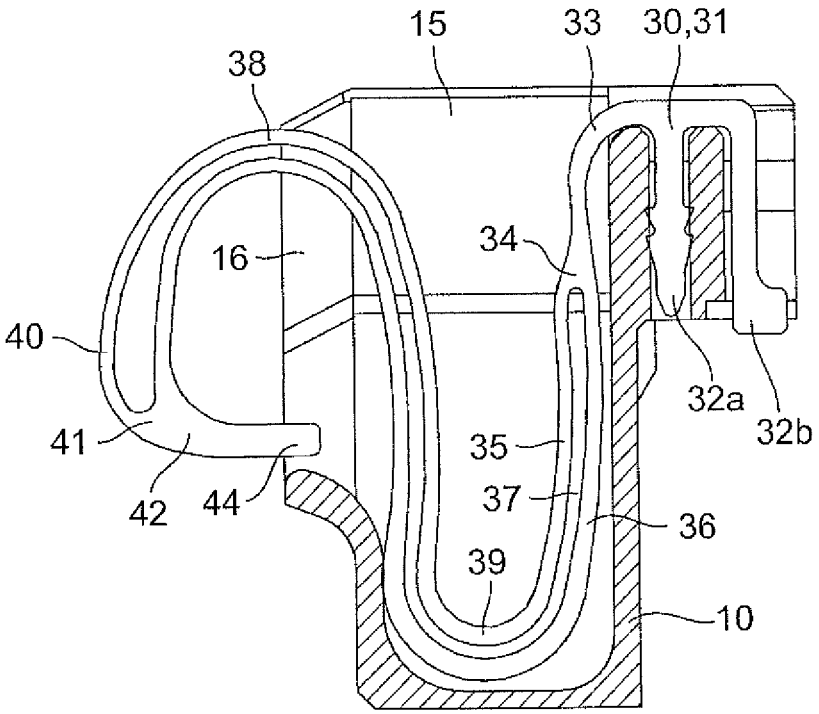
FIGS. 7(A) and 7(B) are sectional views illustrating a connector in which a connection terminal according to a second embodiment is incorporated.
Figure 7B:
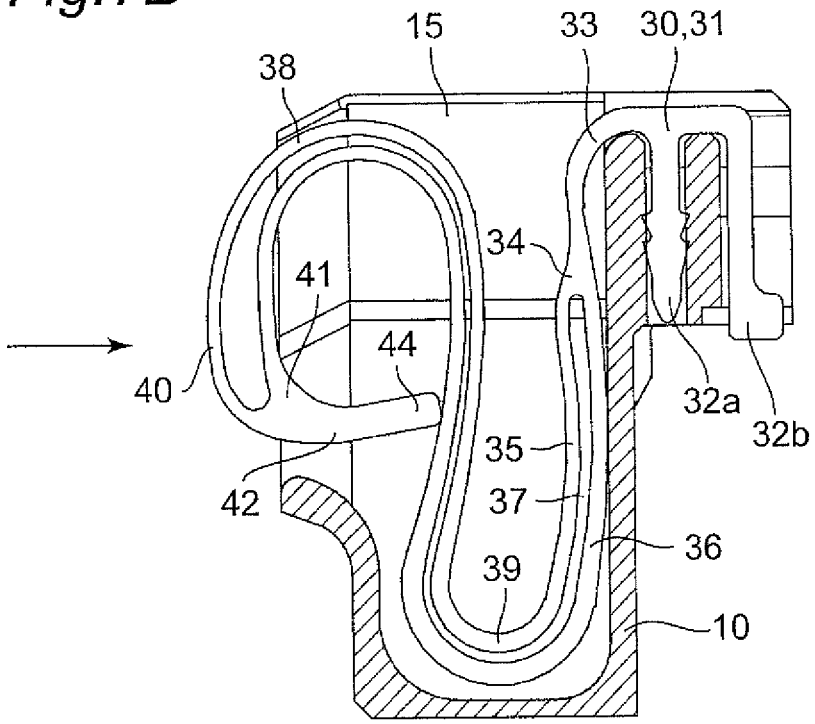
Figure 8A:
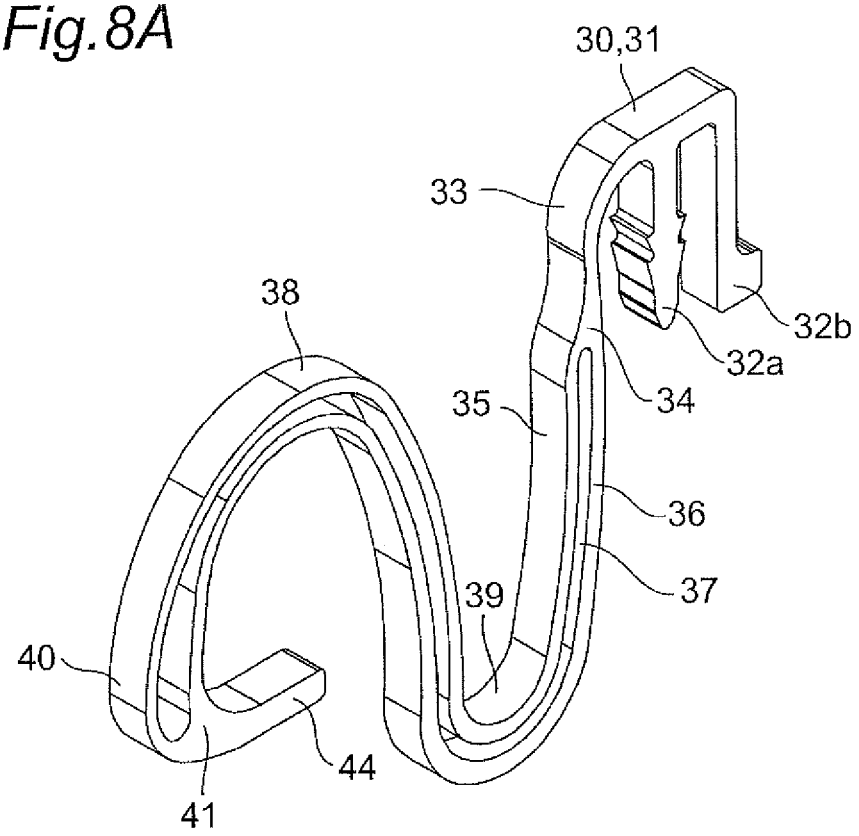
FIGS. 8(A) and 8(B) are a perspective view and a front view illustrating the connection terminal of the second embodiment in FIGS. 7(A) and 7(B).
Figure 8B:
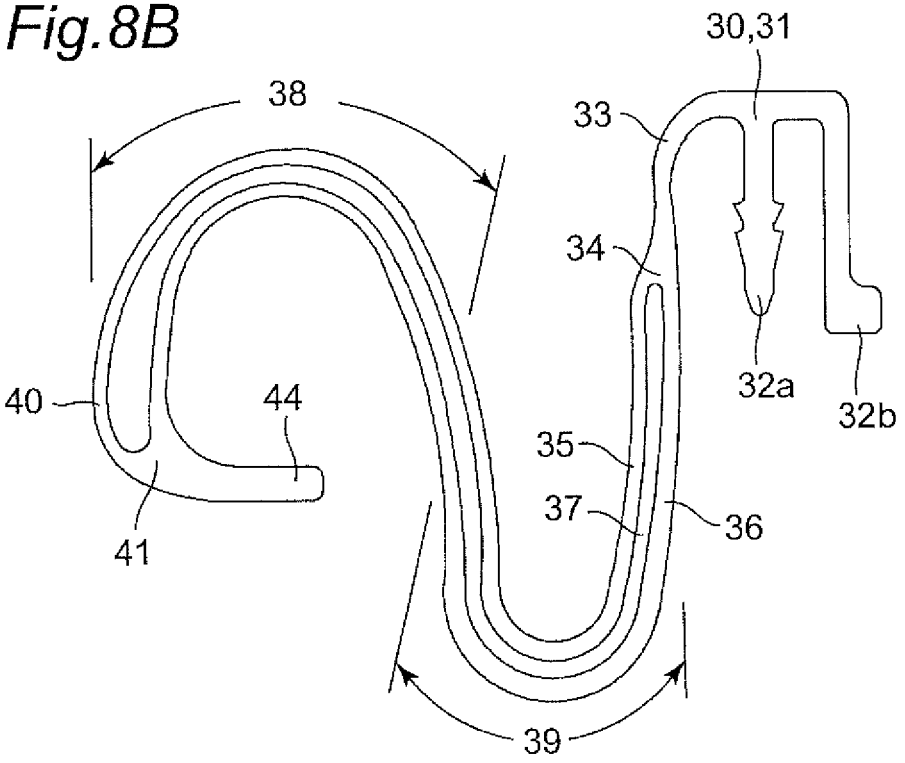

As illustrated in FIGS. 6(A) and 6(B), in connection terminal 30, press-fitting latching pawl 32*a* protrudes downward from an intermediate position of press-fitting fixed portion 31, support 33 extends downward from one end of press-fitting fixed portion 31, and substantial L-shape terminal portion 32*b* extends downward from the other end of press-fitting fixed portion 31.

Meandering first and second extending portions 35 and 36 extend in parallel from branch portion 34 located at a leading end of support 33, whereby first and second curved portions 38 and 39 are formed while slit 37 including a curved portion is formed. Therefore, advantageously the stress is hardly concentrated on branch portion 34, the life is lengthened, and the degree of design freedom increases.

In first curved portion 35, a portion located outermost is used as movable contact portion 40. Leading end portions of first and second extending portions 35 and 36 are united to form coupling portion 41. Position controlling projection 43 extends upward from leading end portion 42 of coupling portion 41 so as to be able to abut on an inner circumferential surface of second extending portion 36 located in first curved portion 38.

In the first embodiment, each of the first and second extending portions 35 and 36 does not have an equal width, but the width of the curved portion located on the outside is larger than the width of the curved portion located on the inside. For this reason, advantageously the stress concentration is further hardly generated during an operation, and the life is lengthened.

The width of slit 37 of the first embodiment is not necessarily uniform, but the width may vary as needed basis.

Figure 4A:
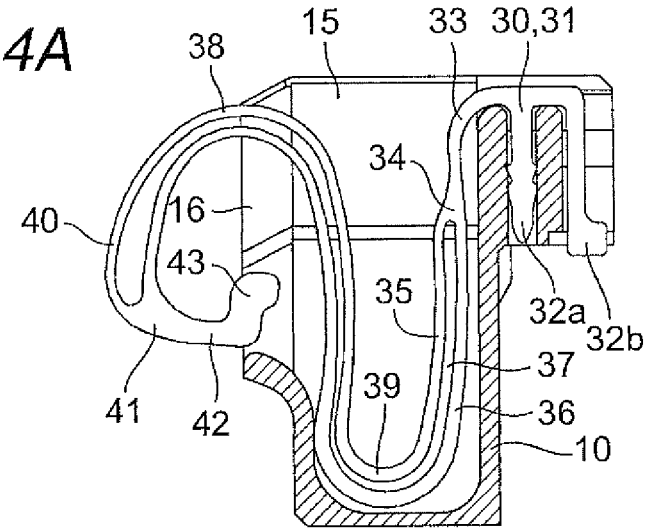
FIGS. 4(A), 4(B), and 4(C) are sectional views illustrating the connector in which the connection terminal of the first embodiment in FIGS. 1(A) to 1(C) is incorporated before, during, and after an operation.
Figure 4B:
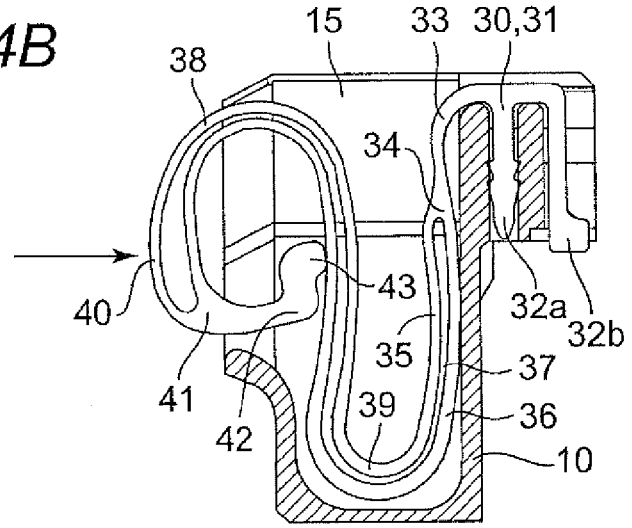
Figure 4C:
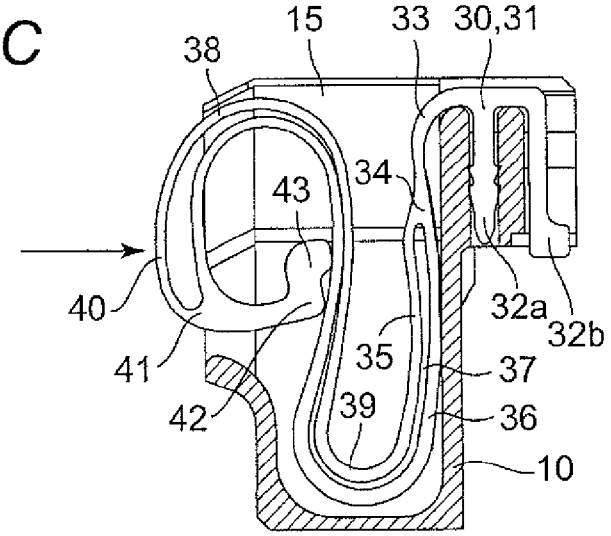

As illustrated in FIGS. 4(A) to 4(C), connection terminal 30 is inserted from above in second storage space 15 of housing 10. Press-fitting latching pawl 32*a* of press-fitting fixed portion 31 is press-fitted and latched in press-fitting latching hole 17. Therefore, the outer circumferential surface located in second curved portion 39 of second extending portion 36 is positioned by abutting on the inner circumferential surface of second storage space 15 (FIG. 4(A)).

Fixing metal fitting 20 is inserted in first storage space 12 of housing 10, and latching pawl 21 of fixing metal fitting 20 is press-fitted in and fixed to press-fitting latching hole 13 of housing 10.

According to the first embodiment, as illustrated in FIGS. 1(C) and 4(A), the lower end face of positioning protrusion 14 provided in the bottom surface of bulging-out portion 11 is flush with the lower end face of positioning support 22 of fixing metal fitting 20 and the lower end face of terminal portion 32*b* of connection terminal 30.

Therefore, when the connector of the first embodiment is assembled in the substantial U-shape notch provided in the edge portion of a printed board (not illustrated) to insert latching pawl 21 of fixing metal fitting 20 in a positioning through-hole made in the printed board, advantageously the connector can be assembled in the printed board with no raffle.

As illustrated in FIG. 4(B), when an external force is applied to movable contact portion 40 of connection terminal 30, first curved portion 38 is initially curved inward, and position controlling projection 43 moves obliquely upward while rotating, and abuts on the inner circumferential surface of second extending portion 36 located in first curved portion 38. When movable contact portion 40 is further pushed, as illustrated in FIG. 4(C), position controlling projection 43 pushes out second extending portion 36 in an outer circumferential direction of a curve of first curved portion 38 (in other words, an opening direction of second curved portion 39) to control the elastic deformation of first curved portion 38, and second curved portion 39 is largely elastically deformed. For this reason, the stress concentration on first curved portion 38 can be blocked to effectively prevent the generation of the plastic deformation.

When the load on movable contact portion 40 is removed, connection terminal 30 can return to an initial position in FIG. 4(A). That is, the shape of position controlling projection 43 is defined so as to come into contact with and separate from the inner circumferential surface of second extending portion 36 within a range in which connection terminal 30 can elastically be deformed.

In the configuration of the first embodiment, position controlling projection 43 abuts on the inner circumferential surface of second extending portion 36 located in first curved portion 38. Alternatively, position controlling projection 43 may abut on a region from first curved portion 38 to second curved portion 39 (a region where first curved portion 38 and second curved portion 39 are continuously coupled to each other).

According to the first embodiment, meandering first and second extending portions 35, 36 and support 33 are arranged between movable contact portion 40 and press-fitting fixed portion 31, and a spring length is long. Therefore, the stress concentration is hardly generated while the desired displacement amount is ensured. For this reason, the long-life connector in which the plastic deformation is hardly generated may be obtained.

In a second embodiment, as illustrated in FIGS. 7(A) to 8(B), position controlling projection 44 extends horizontally from leading end portion 42 of coupling portion 41 to be able to abut on the inner circumferential surface of second extending portion 36 located in first curved portion 38. Because other configurations are identical to those of the first embodiment, the identical component is designated by the identical numeral, and the description thereof is omitted.

According to the second embodiment, since position controlling projection 44 extends horizontally, position controlling projection 44 abuts earlier on the inner circumferential surface of second extending portion 36 compared with the first embodiment. Therefore, advantageously the stress concentration on first curved portion 38 can be blocked to more securely prevent the plastic deformation.

In a third embodiment, as illustrated in FIGS. 9(A) to 10(B), position controlling projection 45 projects from leading end portion 42 of coupling portion 41 to a neighborhood of a ceiling surface of second extending portion 36 located in first curved portion 38. Because other configurations are identical to those of the first embodiment, the identical component is designated by the identical numeral, and the description thereof is omitted.

Figure 9A:
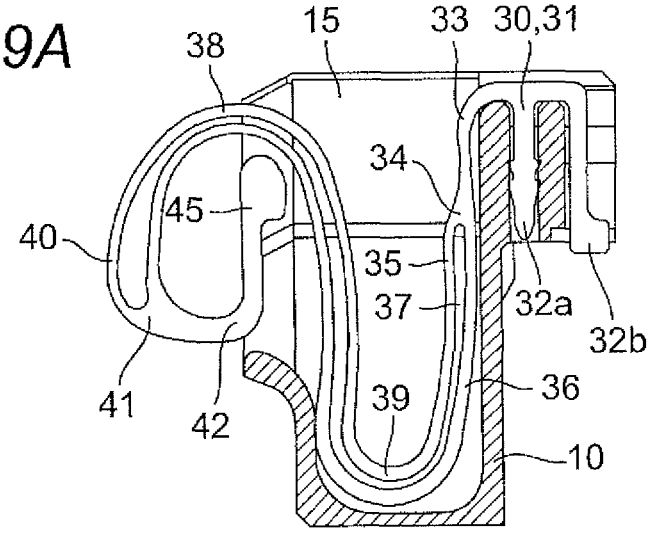
FIGS. 9(A), 9(B), and 9(C) are sectional views illustrating a connector in which a connection terminal according to a third embodiment is incorporated before, during, and after an operation.
Figure 9B:
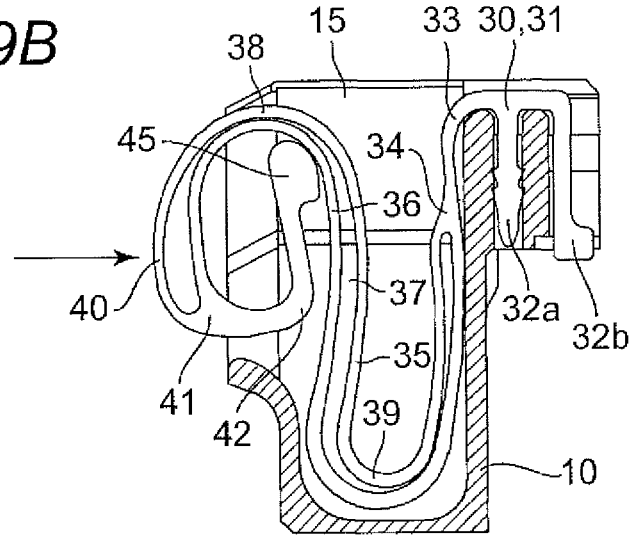
Figure 9C:
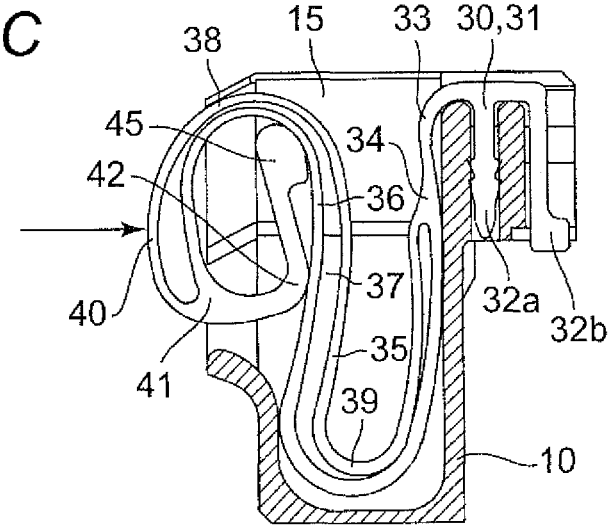
Figure 10A:
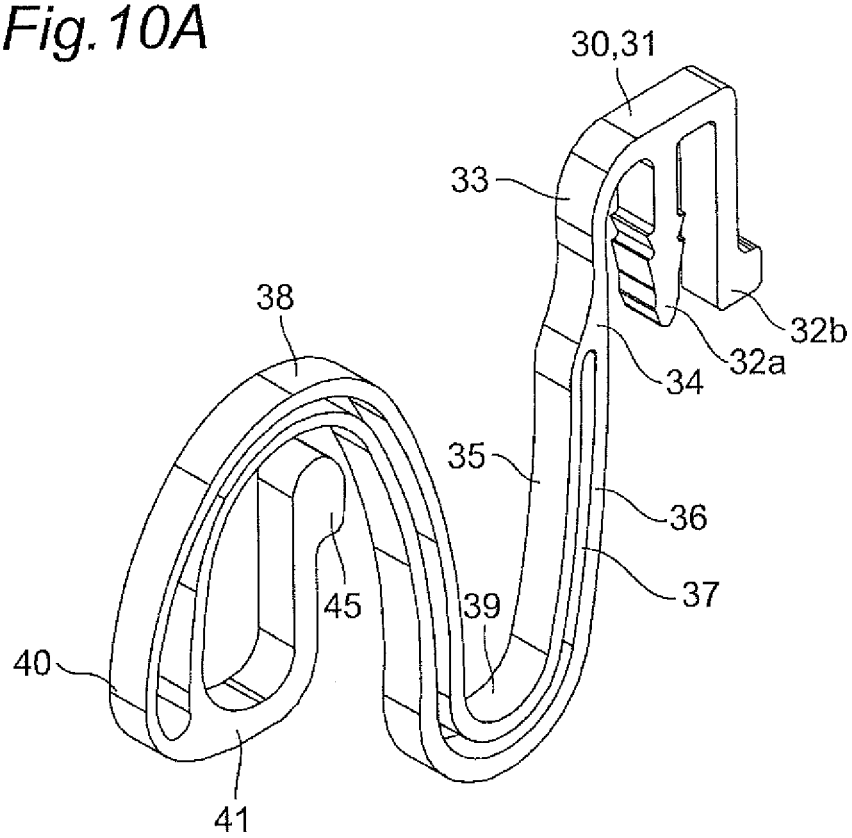
FIGS. 10(A) and 10(B) are a perspective view and a front view illustrating the connection terminal of the third embodiment in FIGS. 9(A) to 9(C).
Figure 10B:
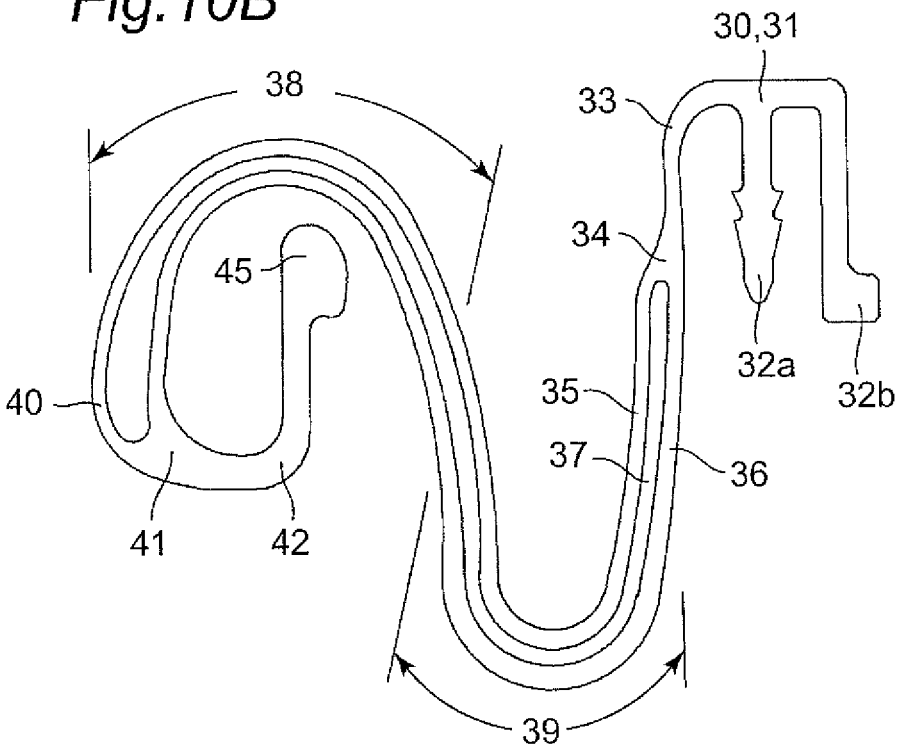

According to the third embodiment, in the case that the external force is applied as illustrated in FIGS. 9(A) to 9(C), an upper end portion of position controlling projection 45 abuts on the inner circumferential surface of second extending portion 36 in first curved portion 38 (FIG. 9(B)) to push out first curved portion 38 in the outer circumferential direction of the curve of first curved portion 38 (in other words, the opening direction of second curved portion 39). Then leading end portion 42 located in a base of position controlling projection 45 abuts on the inner circumferential surface of second extending portion 36 (FIG. 9(C)). Therefore, a deformation amount of first curved portion 38 decreases while a deformation amount of second curved portion 39 increases, so that the stress concentration on first curved portion 38 can be relaxed to prevent the plastic deformation in first curved portion 38.

When the load of the external force is removed, connection terminal 30 can return to the initial position in FIG. 9(A). That is, the shape of position controlling projection 45 is defined so as to come into contact with and separate from the inner circumferential surface of second extending portion 36 within a range in which connection terminal 30 can elastically be deformed.

In the configuration of the third embodiment, position controlling projection 45 abuts on the inner circumferential surface of second extending portion 36 located in first curved portion 38. Alternatively, position controlling projection 45 may abut on a region from first curved portion 38 to second curved portion 39 (a region where first curved portion 38 and second curved portion 39 are continuously coupled to each other).

Figure 11A:
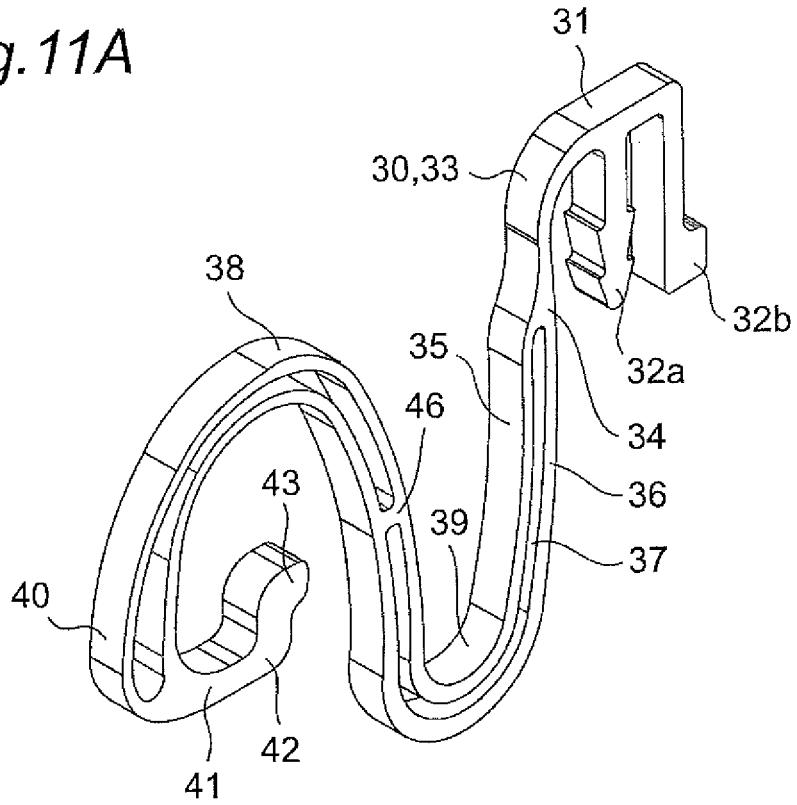
FIGS. 11(A) and 11(B) are a perspective view and a front view illustrating a connection terminal according to a fourth embodiment.
Figure 11B:
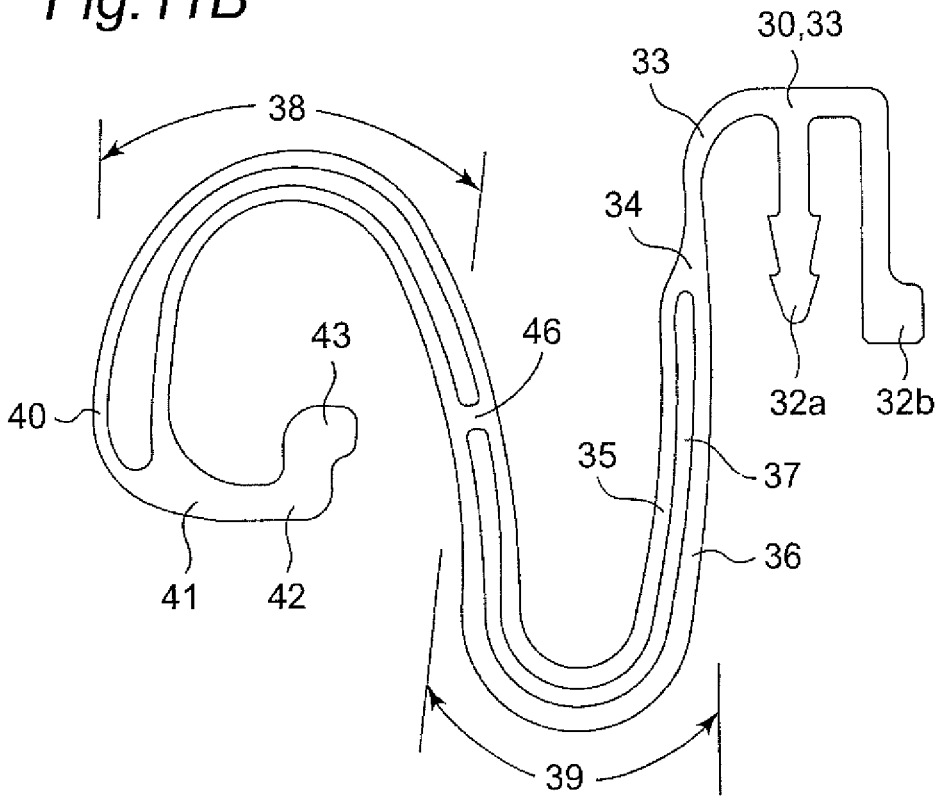

As illustrated in FIGS. 11(A) and 11(B), connection terminal 30 of a fourth embodiment is substantially similar to that of the first embodiment except that first and second extending portions 35 and 36 are coupled to each other in abutment receiving portion 46 provided at a position where position controlling projection 43 abuts on second extending portion 36.

According to the fourth embodiment, rigidity of whole connection terminal 30 is enhanced by providing abutment receiving portion 46, and an impact force can be relaxed during the abutment of position controlling projection 43. Therefore, advantageously a fatigue failure is hardly generated and durability is improved.

Figure 12A:
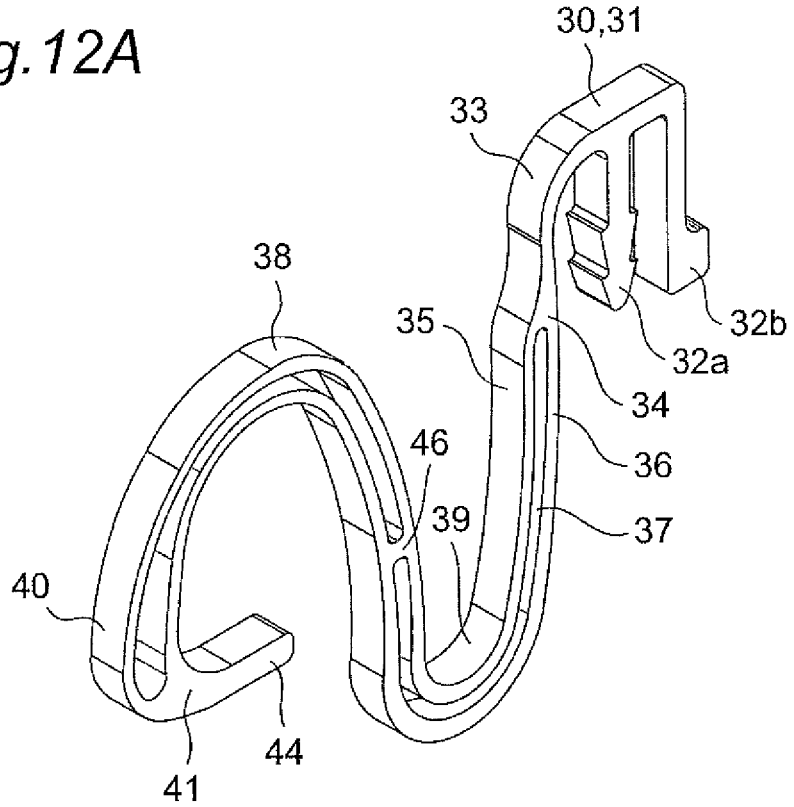
FIGS. 12(A) and 12(B) are a perspective view and a front view illustrating the connection terminal of the fifth embodiment in FIGS. 11(A) and 11(B).
Figure 12B:
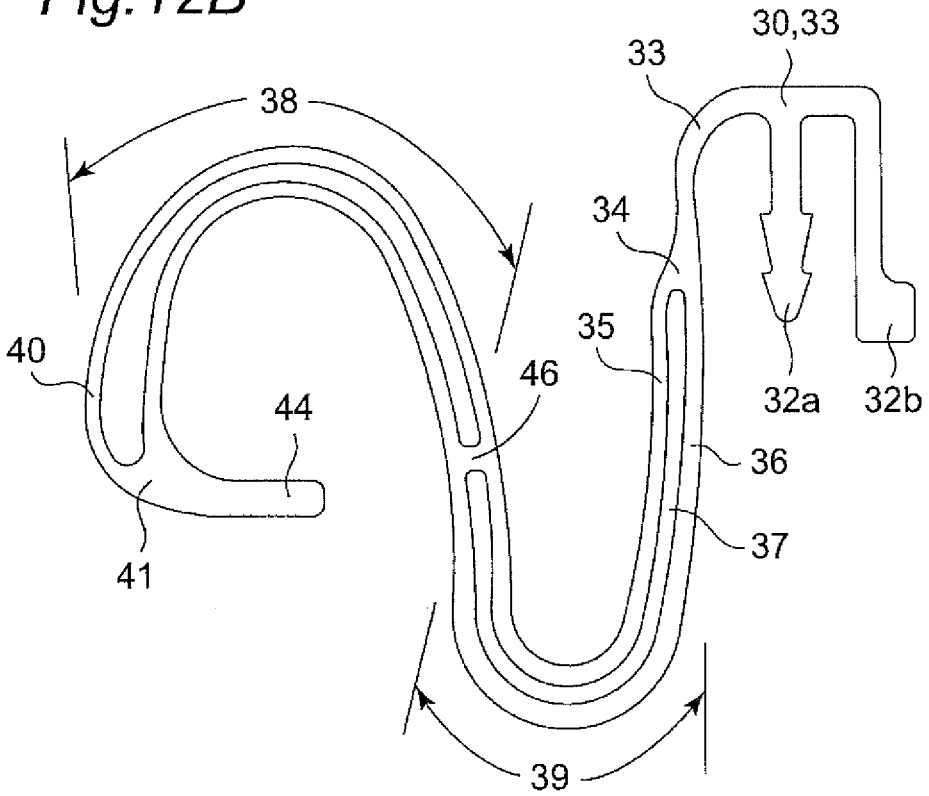

As illustrated in FIGS. 12(A) and 12(B), connection terminal 30 of a fifth embodiment is substantially similar to that of the second embodiment except that first and second extending portions 35 and 36 are coupled to each other in abutment receiving portion 46 provided at the position where position controlling projection 44 abuts on second extending portion 36.

According to the fifth embodiment, the rigidity of whole connection terminal 30 is enhanced by providing abutment receiving portion 46, and the impact force can be relaxed during the abutment of position controlling projection 44. Therefore, advantageously the fatigue failure is hardly generated and the durability is improved.

In one or more of the above embodiments, the description has been made on the case where the set of two connection terminals and the one connection terminal are combined in order to enhance connection reliability. Alternatively, the connector may be composed of only the one connection terminal, or only the set of two connection terminals. A set of three connection terminals may be incorporated, and the number of connection terminals can of course be selected as needed basis.

The extending portion and the slit do not necessarily have the equal width, but the width may be changed as needed basis. For example, in the curved portion of the extending portion, only the width of the curved portion of the extending portion located on the outside is increased, and the generation of the stress concentration may be prevented to enhance durability.

Alternatively, one or plural abutment receiving portions may be provided in the connection terminal. For at least two extending portions, only at least two inside extending portions may be coupled to each other, or all the extending portions may be coupled by the abutment receiving portion. However, the abutment receiving portions are not necessarily arranged on line, but arranged in a zigzag manner. The abutment receiving portion may be arranged in any of the above embodiments, and also applied to other connection terminals.

In one or more embodiments, the description has been made in the case that the connection terminal is incorporated in the housing. Alternatively, the printed board itself may be used as the housing, and the connection terminal may directly be incorporated in the side end face of the printed board. Therefore, advantageously the conventional housing and fixing metal fitting are no longer needed, and consequently a whole device can further be downsized.

EXAMPLES

The connection terminal of the second embodiment was used as Example 1, and the connection terminal of the fifth embodiment was used as Example 2. The number of the operation times was measured until the connection terminal was broken by causing position controlling projections 44 of Examples 1 and 2 to abut on second extending portion 36.

As a result of the measurement, the average number of operation times of Example 2 became about five times that of Example 1. Therefore, usability of the abutment receiving portion was able to be confirmed because of the lengthened life.

The present invention is not limited to the embodiments described above. For example, the connector may of course be formed into a shape that can be surface-mounted on an upper surface of the printed board.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10 Housing
11 Bulging-out portion
15 Second storage space
16 Contact hole
20 Fixing metal fitting
30 Connection terminal
31 Press-fitting fixed portion
32*a* Press-fitting latching pawl
32*b* Terminal portion
33 Support
34 Branch portion
35, 36 First and second extending portions
37 Slit
38, 39 First and second curved portions
40 Movable contact portion
41 Coupling portion
42 Leading end portion
43, 44, 45 Position controlling projection
46 Abutment receiving portion

The invention claimed is:

1. A connection terminal comprising:

a movable contact portion that protrudes so as to be able to be pressed from an outside of a contact hole of a housing; and a first curved portion and a second curved portion that are continuously disposed and that form a substantial S-shape, wherein the movable contact portion is provided in a free end portion of the first curved portion, wherein a position controlling projection extends from the movable contact portion, wherein the position controlling projection abuts on an inner circumferential surface of the first curved portion or a region where the first curved portion and the second curved portion are continuously coupled to each other when the movable contact portion is pressed, wherein the position controlling projection extends from the movable contact portion, wherein a base of the position controlling projection abutting on the inner circumferential surface of the first curved portion after the leading end portion of the position controlling projection abuts on the inner circumferential surface of the first curved portion or the region where the first curved portion and the second curved portion are continuously coupled to each other so as to push out the inner circumferential surface or the region in the opening direction of the second curved portion, wherein the connection terminal further comprises a slit comprising a curved portion between a plurality of extending portions, and wherein the first curved portion and the second curved portion are formed by the plurality of extending portions.

2. A connection terminal comprising:

a movable contact portion that protrudes so as to be able to be pressed from an outside of a contact hole of a housing; and a first curved portion and a second curved portion that are continuously disposed and that form a substantial S-shape, wherein the movable contact portion is provided in a free end portion of the first curved portion, wherein a position controlling projection extends from the movable contact portion, wherein the position controlling projection abuts on an inner circumferential surface of the first curved portion or a region where the first curved portion and the second curved portion are continuously coupled to each other when the movable contact portion is pressed, wherein the connection to terminal further comprises a slit comprising a curved portion between a plurality of extending portions, and wherein the first curved portion and the second curved portion are formed by the plurality of extending portions.

3. The connection terminal according to claim 1, wherein at least one abutment receiving portion that couples a plurality of extending portions is provided at the abutment position of the position controlling projection.

4. The connection terminal according to claim 2, wherein at least one abutment receiving portion that couples the plurality of extending portions is provided at the abutment position of the position controlling projection.

5. A connector comprising:

the connection terminal according to claim 1, wherein the movable contact portion of the connection terminal protrudes so as to be able to be inserted in and taken out from an outside of the contact hole made in the housing.

6. A connector comprising:

the connection terminal according to claim 2, wherein the movable contact portion of the connection terminal protrudes so as to he able to be inserted in and taken out from an outside of the contact hole made in the housing.

7. The connection terminal according to claim 2, wherein the position controlling projection extends from the movable contact portion, and wherein a leading end portion of the position controlling projection abutting on the inner circumferential surface of the first curved portion or the region where the first curved portion and the second curved portion are continuously coupled to each other so as to push out the inner circumferential surface or the region in an opening direction of the second curved portion.

* * * * *